United States Patent [19]

Linyeav et al.

[11] Patent Number: 4,857,006

[45] Date of Patent: Aug. 15, 1989

[54] QUICK CHANGE ELECTRICAL COUPLING

[75] Inventors: Eugene J. Linyeav; Chi-Huang M. Chang, both of Houston, Tex.

[73] Assignee: Western Atlas International, Inc., Houston, Tex.

[21] Appl. No.: 213,712

[22] Filed: Jun. 30, 1988

[51] Int. Cl.[4] ..... H01R 4/64

[52] U.S. Cl. ..... 439/271

[58] Field of Search ..... 439/271–277

[56] References Cited

U.S. PATENT DOCUMENTS

| | | | |
|---|---|---|---|
| 2,605,315 | 7/1952 | Hargett . | |
| 2,700,140 | 1/1955 | Phillips . | |
| 3,176,259 | 3/1965 | MacNamara . | |
| 3,719,918 | 3/1973 | Kerr . | |
| 4,042,291 | 8/1977 | Moriyama . | |
| 4,094,567 | 6/1978 | Karcher et al. . | |
| 4,304,456 | 12/1981 | Takaki et al. . | |
| 4,367,797 | 1/1983 | Brown | 439/271 |
| 4,437,027 | 3/1984 | Yamamoto et al. | 439/271 |
| 4,445,743 | 5/1984 | Bakker . | |
| 4,557,538 | 12/1985 | Chevalier | 439/271 |
| 4,598,967 | 6/1984 | White . | |

*Primary Examiner*—Joseph H. McGlynn
*Attorney, Agent, or Firm*—Browning, Bushman, Zamecki & Anderson

[57] ABSTRACT

An electrical coupling is provided suitable for interconnecting multiple conductors between first and second downhole tools, such as logging tools. The male and female coupling bodies are sealed from the environment such that the mated connector and the conductors within the interior of the mated coupling are sealed from the hostile downhole environment. A threaded ring removably connected to each connector subassembly engages a stop surface on the respective coupling body to limit axial movement of each connector subassembly toward the conductor receiving end of that body. Backup seals provide sealing engagement between each connector subassembly and the respective coupling body, so that fluid cannot be passed along either conductor to the electronics in the adjacent downhole tool housings interconnected with each coupling body if the primary seal between the coupling bodies should fail. According to the method of the present invention, each connector subassembly may be inspected or replaced, if necessary, and the various O-ring seals replaced by removing each connector subassembly from the conductor receiving end of its respective coupling body. The reliability of the coupling is enhanced, the coupling can be easily repaired, no slack need by provided along the length of the conductor, and the mated coupling seals the interior of the coupling and the adjacent electronics from the high pressure downhole fluids.

20 Claims, 4 Drawing Sheets

QUICK CHANGE ELECTRICAL COUPLING

BACKGROUND OF THE INVENTION

1. Field of the Invention

The present invention relates to electrical couplings for use in hostile, high pressure environments and, more particularly, relates to electrical couplings for use in oil or gas wellbores wherein the coupling includes multi-pin replaceable connectors from electronic modules which are pressure sealed from the environment by male and female housings.

2. Description of the Background

Couplings which electrically interconnect single pin and multi-pin electrical connectors are widely used in various industries. Single pin couplings are generally unconcerned with rotational alignment between the coupling halves, while multi-pin couplings typically include an alignment mechanism so that the multi-pin connector subassembly is at its proper rotational orientation with respect to the socket connector subassembly when the coupling is made up. Multi-pin couplings are used, for instance, to enable downhole electrical tools commonly employed in oil and gas well explorations to transmit signals between each other. Such couplings also preferably allow the electrical tools and coupling components to be easily and quickly checked or repaired at the surface of the wellbore. In downhole applications where the electrical coupling interconnects axially spaced instrument housings, the electrical connector subassemblies of such couplings generally must be pressure sealed from the environment so that high temperature and/or corrosive downhole fluids do not contact the connector subassemblies, and the coupling bodies must provide the necessary mechanical connection between the axially spaced instruments.

Electrical couplings typically fall within one of three categories: (1) couplings which electrically interconnect conductors but do not provide a mechanical connection between the electrically connected components, (2) couplings which include male/female bodies which provide a desired or necessary mechanical connection between the axially spaced electrical components (so that the conductors are not placed in tension or compression), but the coupling bodies do not seal the interior cavity within the mated coupler from the environment, and (3) couplings wherein the male/female bodies both mechanically connect the axially spaced electrical components and seal the interior cavity within the mated coupling from the environment, thereby also protecting the electrical conductors passing through the couplings and the associated electronic modules. Couplings of the first type are commonly employed, but are not well suited for use in remote applications or in hostile environments because of poor reliability. Couplings of the second type may be used in remote applications where one is unconcerned with environmental affects on the conductors passing through the couplings. Such couplings typically protect electrical terminals within the coupling by the mated connector assembly, so that the connector rather than the coupling bodies provides any environmental protection. Accordingly, the male and female coupling bodies of such couplers primarily provide the mechanical connection between electrical components along the conductor line, and may cooperate with other coupling parts to protect the electrical terminals, but the coupling bodies do not seek to seal along the entire length of the conductors passing through the coupling.

If opposite ends of the conductors each extend into a respective housing which in turn protects electrical connections, instruments or other components within each housing, the conductor must also be sealed with each additional housing to protect these electrical components from the environment. Couplings of the latter type, which provide a fluid-tight seal between each coupling body and seal both the connectors within the coupling and the conductors passing through the coupling, are preferred or required in many situations. In many remote and hostile environments, each of the male and female coupling bodies which provides the mechanical interconnection is preferably in sealed engagement with a respective axially positioned housing or conduit which in turn protects the electrical connections, instruments or other components within those axially positioned housings. In downhole environments, the coupling body must often withstand a pressure of hundreds or even thousands of psi to seal the connectors from the fluids. Coupling bodies of this type thus have two separate sealing functions: (1) the coupling body seals the electrical connectors from the environment, and (2) the coupling body seals the electrical conductor passing through the coupling and, most importantly, cooperates with the axially positioned housings at each end of the coupling to provide a reliable continuation of the fluid-tight seal to protect the electrical components within the adjacent housings.

Downhole couplings are frequently broken-apart and made-up at the surface to check or repair coupling components, especially the connectors within the coupling. Downhole couplings are thus typically provided with cooperating threads on the male and female bodies, and a seal for sealing the bodies and thus the cavity within the mated coupling from the environment. The conductor receiving end of each coupling body may be provided with threads for effective engagement with an electrical instrument housing, and is typically provided with a seal for sealing engagement between the coupling body and its respective housing. When the downhole coupling is returned to the surface for routine maintenance or repair, the coupling bodies may be unthreaded and the exposed electrical connections checked and replaced, if necessary, while the coupling body to instrument housing connection generally remains intact. Alternatively, it is often desirable to disassemble the coupling to replace the O-ring seals after prolonged exposure to the high temperature, high pressure downhole environment.

A significant problem with fully sealed downhole couplings as described above relates to failure of the seal between the male and female coupling bodies, resulting in fluid pressure contamination of the electrical components within the housing at the conductor receiving end of the coupling body. While the likelihood of contamination of the electrical conductors and components within the axially positioned housings adjacent the coupling might theoretically be lessened by providing a backup seal between each electrical connector or each conductor connected thereto with each respective coupling body, this technique does not provide a practical solution to the problem since leaked fluid pressure acting on the connectors will also tend to axially separate the conductors, thus breaking the electrical connection.

It is also desirable for a downhole electrical coupling to be designed such that "slack" is not required in the electrical lines leading to the connector pins. This helps to avoid broken electrical connections when the couplings are disassembled in the field to replace the O-rings during surface repair operations. In other words, when the coupling is unmated at the surface and each connector is pulled axially through the open conductor receiving end of its respective coupling body to inspect the connector and change the O-rings, slack would typically be provided in the conductor lines to provide this additional line length which enables the connector to be pulled through the open end of the unmated coupling body.

A primary problem with prior art couplings intended for hostile environments relates to their complexity. Such couplings are frequently both costly to manufacture and difficult to repair. U.S. Pat. No. 4,598,967, for example, discloses an electrical coupling suitable for use in an oil and gas wellbore, wherein the coupling includes a pair of inner sleeves each positioned within a respective coupling body. One of the sleeves is biased toward the center of the coupling, and a pressure relief port opens the interior of the coupling body to the environment. The seal between the mated male and female bodies of the coupling is not provided since separate seals engage each sleeve in its respective coupling body.

The disadvantages of the prior art are overcome by the present invention, and an improved and relatively simple electrical coupling is provided which pressure-isolates the connector subassembly, the conductors passing through the coupling body and the adjacent electrical modules from the environment.

SUMMARY OF THE INVENTION

The interior of the electrical coupling of the present invention is pressure sealed from the exterior, and the coupling is thus well suited for use in hostile environments. The coupling may be used for interconnecting downhole electrical instruments used for logging an oil or gas well. The high pressure, high temperature and/or corrosive downhole fluids are thus precluded from contacting the male/female multi-pin connector within the mated coupling. Moreover, even if the primary seal between the mated male and female coupling bodies should leak, downhole pressure does not break apart the connectors and invade the adjacent electronic modules.

The coupling of the present invention includes a male body and a female body each having a cable receiving end and a mating end. The cable receiving end of each coupling body includes threads for mated engagement with an axially positioned housing or conduit for protecting the downhole instruments and electronic modules electrically interconnected by the coupling. The axially positioned housings are thus in sealed engagement with the respective coupling body, so that the mated coupling seals the connector within the coupling, assists in sealing each of the adjacent housings from the environment and provides the desired mechanical connection between the axially positioned housings.

The male and female coupling bodies are threaded for mated engagement, and a primary seal is provided adjacent the threads for sealing the interior of the mated coupling bodies. A pin connector subassembly is generally positioned in one of the bodies with a socket connector subassembly in the other body. A removable stop member is provided within each body for threaded engagement with the respective connector subassembly, and for engagement with a stop surface on the body to limit axial movement of the connector subassembly toward the conductor receiving end of that body. Accordingly, the sto member may be unthreaded from its connector subassembly and removed through the mating end of the coupling body, and the body then moved axially so that the connector subassembly exits the cable receiving end of the body which housed that connector subassembly. A backup seal is provided between the coupling body and each connector subassembly so that fluid cannot leak past the connector subassembly to the electrical instruments if the primary seal should fail. Moreover, this leakage of fluid pressure does not break the mated connector subassembly due to the engagement of the stop members fixed to each connector subassembly with their respective stop surfaces on the coupling bodies. Axial movement of each connector subassembly toward the mating end of its respective coupling body is preferably limited by an additional stop surface on that coupling body.

According to the method of the present invention, each conductor is preferably interconnected at one end to an electrical instrument and at the other end to a respective connector subassembly. Each coupling body is then slid over the connector subassembly and conductor until axial movement is limited by engagement with a stop surface on the coupling body. A stop member is then inserted through the mating end of each coupling body and fixed to the respective connector subassembly within that body by engagement with another stop surface on the body. This prevents axial movement of each connector subassembly within each coupling body and maintains the seals of each connector subassembly in sealing engagement with a cylindrical interior wall of its respective coupling body. The coupling bodies may then be brought into engagement by rotating a slip ring on one of the bodies, which is adapted for threaded engagement with corresponding threads on the other body.

It is a feature of the present invention to provide a dependable electrical coupling suitable for use in hostile environments, wherein the interior of the mated coupling is pressure sealed from the environment.

It is another feature of the invention to provide an electrical coupling with stop surfaces for prohibiting axial separation of the mated connector within the coupling body and leakage into the adjacent electronic modules if the primary seal between the coupling bodies should leak.

It is another feature of the present invention to provide a simplistic yet reliable electrical coupling for use in interconnecting conductor lines each connected at one end to electrical components, wherein the O-rings sealing the adjacent electronic subassemblies within each coupling body may be replaced and the connector subassemblies checked and replaced, if necessary, without providing slack in each conductor between the electrical components and the connector subassembly.

It is a further feature of the present invention to provide an electrical coupling for interconnecting downhole electrical tools, such as downhole logging tools.

It is a further feature of the present invention to provide a downhole electrical coupling for interconnecting multi-pin connectors which are easily replaceable.

Advantages of the present invention are that the coupling does not fail due to separation of the connectors if the primary seal between the male and female coupling bodies were to leak, and fluid is prohibited from passing to adjacent electrical components by backup seals between each connector subassembly and the coupling bodies.

These and other objects, features, and advantages of the present invention will become apparent from the following detailed description, wherein reference is made to the figures in the accompanying drawings.

DETAILED DESCRIPTION OF THE PREFERRED EMBODIMENTS

The electrical coupling of the present invention is well suited for use in downhole applications typically encountered in the petroleum recovery industry. Accordingly, the coupling will hereinafter be described for use in connecting two logging tools each having an outer housing and electrical connections, electronic modules, or similar components within each housing. The coupling of the present invention seals the mated connector within the coupling from high temperature, high pressure and/or corrosive fluids in the wellbore, and further cooperates with both the adjacent instrument housings to seal the electrical components within those housings.

Figure 1:
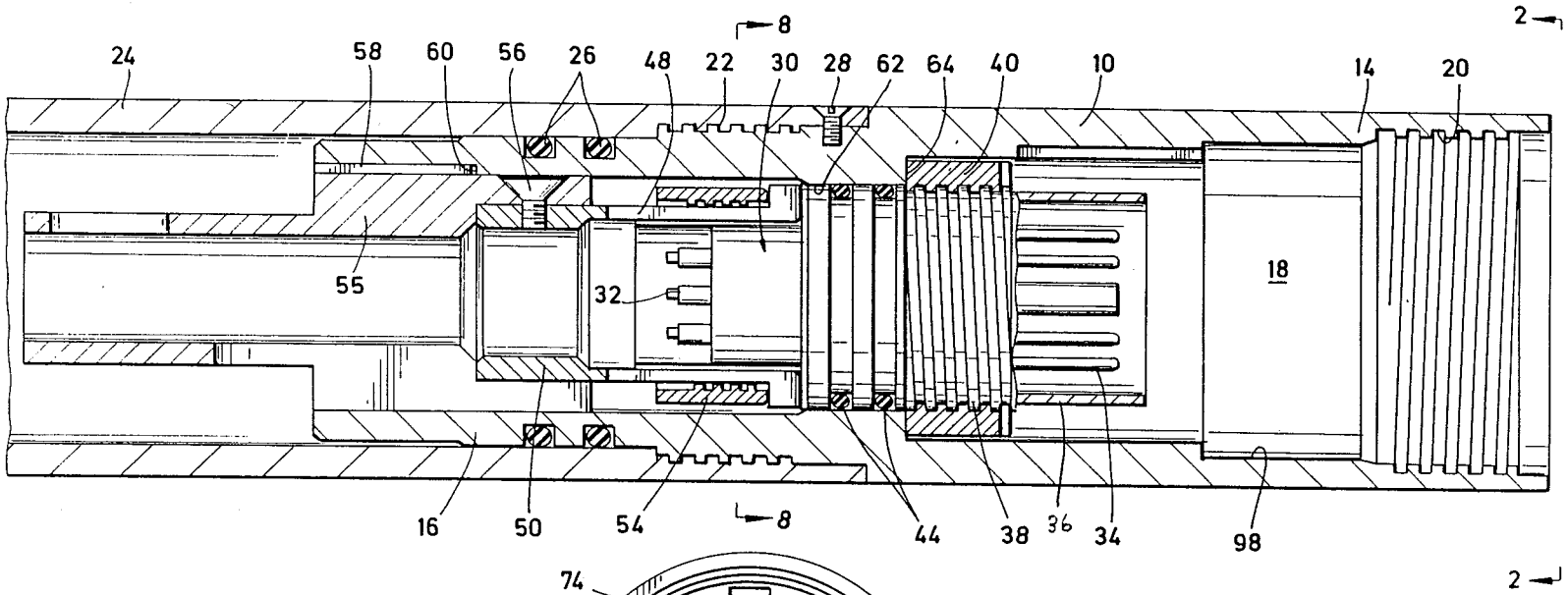
FIG. 1 is a pictorial view, partially in cross-section, of a female housing of a coupling according to the present invention in sealed engagement with a first electrical instrument housing.
Figure 3:
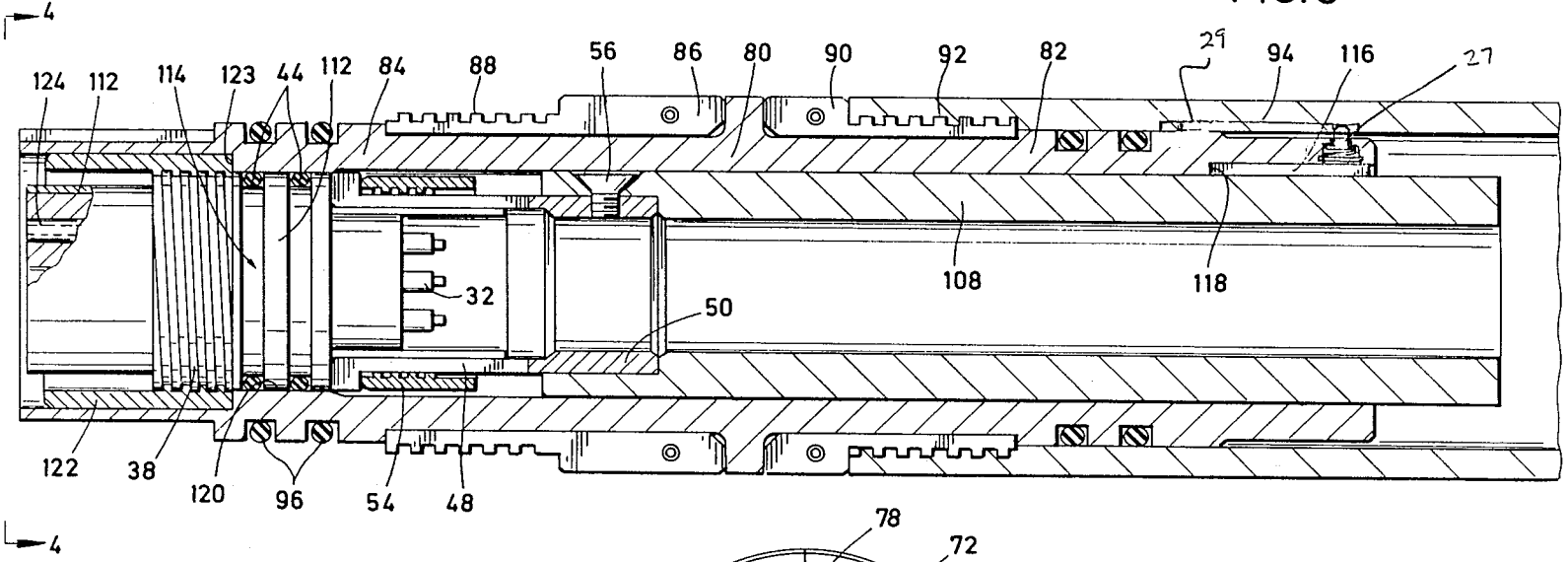
FIG. 3 is a pictorial view, partially in cross-section, of a male housing of a coupling according to the present invention in sealed engagement with a second electrical instrument housing.

FIGS. 1 and 3 illustrate the unmated female and male coupling bodies, respectively. The female body or sub 10 is a generally cylindrical unit having a coupling mating end 14 and a conductor receiving end 16. The mating end defines a male-receiving cavity 18 with threads 20 for engagement with the male coupling body described subsequently. The conductor receiving end 16 is threaded at 22 for engagement with a first logging instrument housing 24 which houses electrical devices or components (not shown). A securing member 28 is used for rotatably locking the female body 10 and the housing 24 together. Although these components may remain fixed together when the coupling is retrieved to the surface for repair, it is often desirable to disassemble the coupling to replace the various O-ring seals described subsequently. O-ring seals 26 provide sealing engagement between female body 10 and housing 24, which are preferably each axially aligned and have a substantially uniform diameter.

Figure 7:
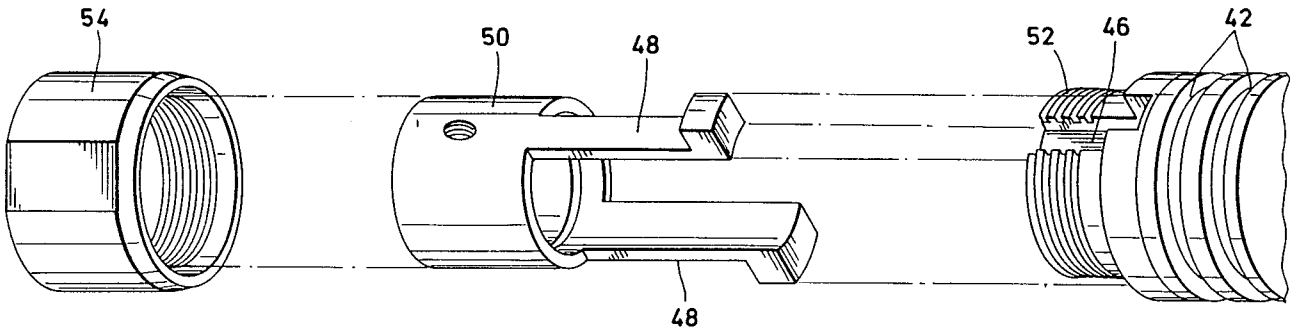
FIG. 7 is an exploded pictorial view of a conductor sleeve to a connector subassembly connection according to the present invention.
Figure 8:
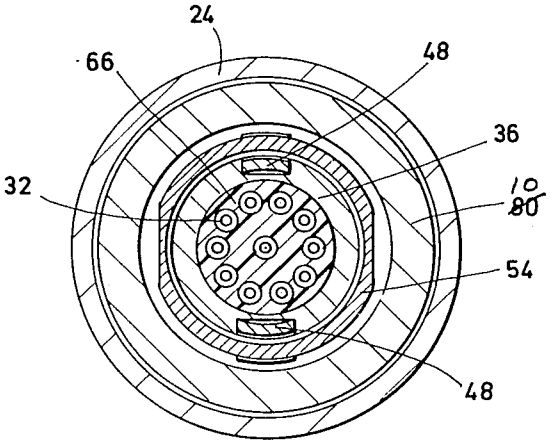
FIG. 8 is a cross-sectional view of the female coupling housing of FIG. 1 through the line 8—8.

A plurality of conductors (not shown in the drawings for clarity) are each connected at one end to electrical components within the logging instrument housing 24 and are each connected at the other end to pin connector subassembly 30. Assembly 30 includes circumferentially spaced and numbered terminals 32 at one end of the assembly 30 each for receiving a respective conductor, a plurality of conductor pins 34 at the opposite end of the assembly 30, a body 36 for housing electrical lines which interconnect the terminals 32 and the respective pins 34, and insulating material 66 for isolating the various electrical parts. Body 36 includes threads 38 for threaded engagement with stop ring 40, grooves 42 for receiving O-ring seals 44, a pair of radially opposing slots 46 each for receiving a respective leg 48 of end piece 50, and threads 52 for engagement with retaining nut 54 (see FIG. 7 for clarity).

During assembly, the conductors (not shown) are positioned within sleeve 55, which is secured by bolts 56 to end piece 50. With each conductor connected to a respective terminal 32, the legs 44 of the end piece are positioned within the respective slots 46, and the retaining nut 54 is threaded at 52 to body 36 to form a subassembly 30 for insertion into the conductor receiving end 16 of the male body 10. During insertion, the locking key portion 58 of sleeve 55 must be rotatably aligned with a corresponding slot in body 10. This subassembly 30 is then axially inserted until key 58 engages stop surface 60 which limits further axial movement of the connector subassembly 30 toward end 14. In this position, O-ring seals 44 are in sealing engagement between conductor body 36 and the cylindrical surface 62 of female body 10. A stop member, such as retaining nut 40, is then inserted into the open end 14 of the body 10, and threaded at 38 until nut 40 engages stop surface 64 on body 10. At this stage, the connector subassembly 30 is axially fixed within the female body 10.

Figure 2:
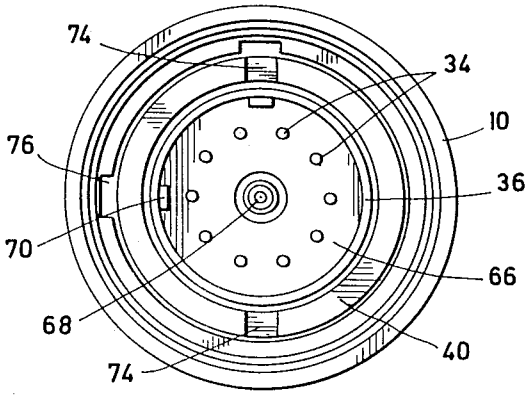
FIG. 2 is an end view of the female coupling housing of FIG. 1 from the line 2—2.

FIG. 2 illustrates the plurality of pins 34 each positioned within the insulation 66 of subassembly 30, and positioned circumferentially about center pin 68. Body 36 is provided with a pair of rectangular-shaped keys 70 for fitting within slots 72 (see FIG. 4). Locking nut 40 is also provided with radially opposing end slots 74 for receiving protruding tabs of a suitable tool (not shown) for facilitating threaded rotation of the nut 40 to body 36. Finally, the body 10 is provided with slots 76 for receiving keys 78 (see FIG. 4).

Figure 6:
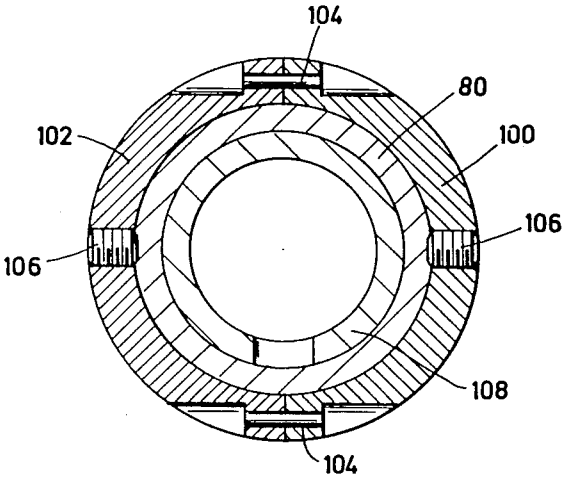
FIG. 6 is a cross-sectional view through either of lines 6—6 of the mated coupling of FIG. 5.

FIG. 3 illustrates the male coupling body 80 having its conductor receiving end 82 and its coupling mating end 84. A first split ring 86 is axially fixed to body 80 and includes threads 88 for mated engagement with threads 20 of the female body 10. A second split ring 90 includes threads 92 for engaging the second logging instrument housing 94. Body 80 and housing 94 may be rotatably fixed by seating of spring loaded key 27 projecting from body 80 into alignment slot 29 in housing 94. O-ring seals 26 seal between housing 94 and body 80, while O-ring seals 96 seal between male body 80 and cylindrical surface 98 on female body 10. Further details regarding the split rings 86 and 90 are shown in FIG. 6. Each split ring comprises ring halves 100 and 102 which are secured together by radially opposing pins 104 or screws. One or more set screws 106 in each ring may be used to rotatably affix the ring to body 80, although with screw 106 unthreaded, each ring may freely rotate yet remain axially fixed on body 80.

Figure 4:
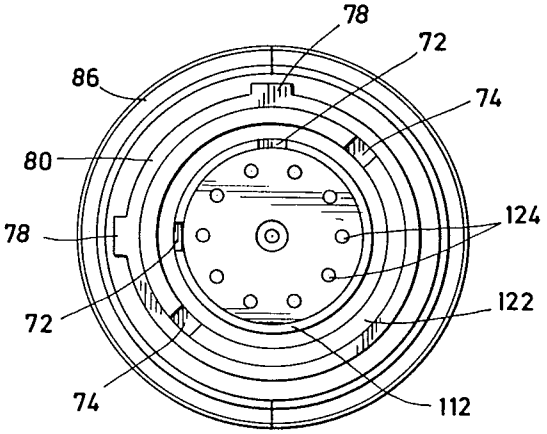
FIG. 4 is an end view of the male coupling housing of FIG. 3 from the line 4—4.

During assembly, the conductors (not shown) are each positioned within the sleeve 108 which is fixed to the end piece 50 by screw 56. The conductors are each attached at a terminal 32, and the retaining nut 54 threaded to the body 112 of socket conductor assembly 114. The sleeve 108 and socket connector assembly 114 are thus projecting from the end of housing 94. Body 80, with split rings 86 and 90, is inserted over the sleeve 108 and rotated until key 27 is engaged in slot 29 after which the threads of split ring 90 engage threads 92 of housing 94. Threading of split ring 90 into housing 94 pulls O-ring seals 26 into sealing engagement within housing 94 until the key 116 on the sleeve 108 engages the stop surface 118 on the body 80. At this stage, the O-ring seals 44 are in sealing engagement with cylindrical surface 120 of body 80, and the retaining ring 122 may be threaded to body 112 at 38 until it engages the stop surface 123. FIGS. 3 and 4 illustrate the plurality of cylindrical-shaped receptacles 124 each adapted for receiving a respective one of the pins 34 shown in FIG. 1. Retaining ring 122 includes rectangular grooves 74 for receiving a tool to facilitate rotation of the ring 122. Body 112 includes slots 72 for receiving the keys 70 shown in FIG. 2, and the male body 80 includes keys 78 for fitting within the corresponding slots 76 also shown in FIG. 2.

Figure 5:
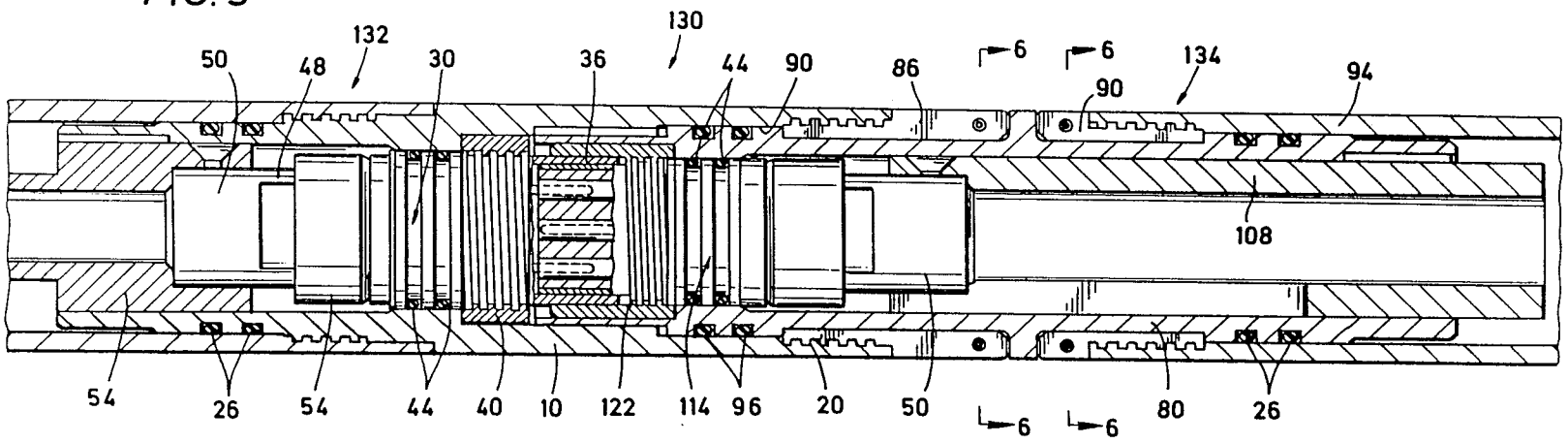
FIG. 5 is a pictorial view, partially in cross-section, of a mated coupling according to the present invention.

The mated coupling 130 of the present invention is depicted in FIG. 5. The female coupling half 132 as shown in FIG. 1 is sealed with the male coupling half 134 as shown in FIG. 3. Prior to mating, the male and female coupling bodies are rotatably aligned so that the keys 78 in the male body 80 enter slots 76 in the female body 10. Since connector subassembly 130 is rotatably fixed with respect to the body 10 by the piece 50 and the connector subassembly 114 is similarly fixed to the body 80 by its end piece 50, keys 70 and pins 34 are thus respectively aligned with slots 72 and receptacles 124.

The mating operation is accomplished at the surface of the wellbore by rotating slip ring 86 to make up threads 20 and bring seals 96 into engagement with cylindrical surface 98 of the female body 10. At the same time, the connector subassemblies 30 and 114 are brought into mating engagement. When the coupling 130 is returned to the surface, the slip ring 86 may be rotated to separate the coupling halves 132 and 134, thereby again separating the connector subassemblies which may then be inspected and, if necessary, repaired or replaced, including replacement of the various O-ring seals.

A feature of the present invention is that the coupling is configured so that the connector subassemblies 30 and 114 may each be easily replaced even though there is no conductor slack between the electrical components in the respective housings 24 and 94 attached to each coupling body 10 and 80, respectively, and the connector subassemblies. Such slack, which may be provided so that each connector subassembly may be pulled through the coupling mating end of each coupling body to inspect or replace the connector subassemblies, decreases reliability of the coupling and increases chances for broken connections. This slack is not required, however, according to the present invention, since each connector subassembly may be inspected and the O-ring seals replaced by axially moving the coupling body so that the connector subassembly is effectively withdrawn from the conductor receiving end of the body.

More particularly, the split ring 86 may be rotated to disconnect the coupling halves 132 and 134, while each coupling body 10 and 80 preferably remains in sealed engagement with its attached housing 24 and 94, respectively. Referring to FIG. 1, a tool may then be inserted through the coupling mating end 14 of the body 10, so that extending tabs on the tool will fit within slot 74 of nut 40. Accordingly, the nut 40 may be unthreaded from the conductor subassembly 30, and the body 10 and housing 24 then moved axially so that the subassembly 30 exits the conductor receiving end 16 of the body 10. Axial movement of the body 10 and the housing 24 thus exposes the conductor and the subassembly 30, so that the O-ring seals may be easily replaced and so that subassembly 30 may be more fully inspected and, if necessary, easily repaired or replaced. Once repaired, the coupling half 132 may then be reassembled with no slack in the conductor. Similarly, threads 92 are disengaged so that body 80 may be withdrawn from housing 94 and from about sleeve 108 so that the O-ring seals may be easily replaced and so that subassembly 114 may be more fully inspected and, if necessary, easily repaired or replaced.

As shown in FIG. 5, an advantage of the present invention is that fluid pressure is prevented from entering either housing 24 or 94 by the backup seals 44 between each connector subassembly 30, 114 and its respective body 10, 80 even if the seals 96 between the male and female coupling bodies were to leak or fail. Moreover, fluid pressure cannot force the connector subassemblies 30, 114 apart to break the electrical connection, since each subassembly is prevented from moving toward the conductor receiving end of its respective housing due to engagement of the interconnected nuts 40 and 122 with their respective bodies 10 and 80. Thus the reliability of a coupling according to the present invention is substantially improved since failure of the seal between the male and female coupling components cannot act to break the electrical connection formed by the connector subassemblies.

While the coupling herein described has utility for mechanically connecting logging tools in downhole environments and for electrically connecting conductors passing from each of those logging tools through the mated coupling, the invention is not limited to connecting logging tools and has utility for interconnecting various electrical tools which are subjected to a high fluid pressure environment. Also, various modifications will be suggested by the above disclosure which are within the scope of the present invention. By way of example, the female coupling body may house the socket connector subassembly, while the pin connector subassembly is within the male coupling body. Also, the backup seals 44 may be provided along the conductor, the end piece 50, and/or the retaining nut 54 rather than being provided on the connector subassemblies 30, 114 although the embodiment previously described and illustrated is preferred for simplicity and high reliability. The seals 26 could be carried on the housings 24 and 94, while seals 44 could be carried on the male and female coupling bodies for sealing engagement with the connector subassemblies. The keys and alignment slots described herein may be reversed, wherein each component is on the opposing coupling half. Also, other alignment mechanisms may be used for insuring that the components are in proper rotational alignment when the coupling is mated. For example, spring loaded key 27 may be located in sleeve 108 instead of body 80 to directly align sleeve 108 with slot 29 in housing 94. The stop member or nut 40, 122 preferably projects radially outward from the generally cylindrical-shaped connector subassembly 30, 114, so that the stop member interconnected with each subassembly may then engage the stop surface on the coupling body also positioned radially outward of each subassembly and axially adjacent the subassembly. The stop member may, however, have a diameter greater than the subassembly but engage a surface in the coupling body axially spaced from the subassembly, or the stop member may have a diameter less than the subassembly and engage a surface in the coupling body between the subassembly and the mating end of the coupling body. The stop member which limits axial movement of the connector subassemblies toward the conductor receiving end of each coupling body may also be mechanically secured to its respective connector subassembly by standard mechanisms other than threads. Finally, various techniques may be used for attaching the conductors to the respective connector subassemblies other than those herein described.

Other alternative forms of the present invention will suggest themselves from a consideration of the apparatus and techniques described herein. Accordingly, it should be understood that the apparatus herein described and shown in the accompanying drawings are intended as exemplary embodiments of the present invention, and not as limitations thereto.

What is claimed is:

1. An electrical coupling for interconnecting electrical conductors between a first downhole electrical tool having a first exterior housing and a second downhole electrical tool having a second exterior housing, the coupling having male and female bodies each having a conductor receiving end and a coupling mating end, the conductor receiving end of the male coupling body adapted for sealing engagement with the first downhole tool housing, and the conductor receiving end of the female coupling body adapted for sealing engagement with the second downhole tool housing, the coupling further comprising:

a primary coupling seal for sealing engagement between the male and female bodies when the coupling is mated;

a pin connector removably positioned within one of the coupling bodies and having at least one electrical connector pin extending axially therefrom;

a socket connector removably positioned within the other of the coupling bodies and having at least one electrical connector socket adapted to engage the at least one pin, the pin connector and socket connector forming a mated connector when the coupling is mated;

the male coupling body having a first stop surface for limiting axial movement of the mated connector toward the conductor receiving end of the male coupling body;

the female coupling body having a second stop surface for limiting axial movement of the mated connector toward the conductor receiving end of the female coupling body;

a first stop member removably fixed to the connector within the male coupling body for engagement with the first stop surface to limit axial movement of the mated connector with respect to the male coupling body, the first stop member projecting radially outward from an exterior surface of the connector within the male coupling body such that the first stop member may be disconnected from the connector, and the male coupling body then moved axially with respect to the connector to remove the connector from the male coupling body through the conductor receiving end of the male coupling body;

a second stop member fixed to the connector within the female coupling body for engagement with the second stop surface for limiting axial movement of the mated connector with respect to the female coupling body, the second stop member projecting radially outward from an exterior surface of the connector within the female coupling body such that the second stop member may be disconnected from the connector, and the female coupling body then moved axially with respect to the connector to remove the connector from within the female coupling body through the conductor receiving end of the female conducting body;

a first backup seal for sealing engagement between the male coupling body and the connector within the male coupling body while the first stop member is in engagement with the first stop surface; and a second backup seal for sealing engagement between the female coupling body and the connector within the female coupling body while the second stop member is in engagement with the second stop surface.

2. An electrical coupling as defined in claim 1, further comprising;

the pin connector having a plurality of electrical connector pins extending axially therefrom;

the socket connector having a plurality of electrical connector sockets therein each adapted to engage a respective one of the plurality of pins; and an alignment member on each of the male and female coupling bodies to rotatably align each of the plurality of pins with each of the plurality of sockets.

3. An electrical coupling as defined in claim 1, further comprising:

the male coupling body having a third stop surface for limiting axial movement of the connector within the male coupling body toward the coupling mating end of the male coupling body; and the female coupling body having a fourth stop surface for limiting axial movement of the connector within the female coupling body toward the coupling mating end of the female coupling body.

4. The electrical coupling as defined in claim 1, wherein each of the pin connector and socket connector have a generally cylindrical configuration, and the first stop surface on the male coupling body and the second stop surface on the female coupling body are each radially outward of the cylindrical shaped connector within the male and female coupling bodies, respectively.

5. The electrical coupling as defined in claim 1, wherein each of the male and female coupling bodies has a cylindrical surface adapted for sealing engagement with the first or second backup seals, respectively.

6. The electrical coupling as defined in claim 1, wherein each of the first and second stop members are threadably connected to the respective connector.

7. The electrical coupling as defined in claim 1, wherein the male and female coupling bodies each include threads for repeatedly mating and unmating the coupling bodies.

8. The electrical coupling as defined in claim 7, further comprising:

a slip ring axially affixed to the female coupling body and having threads for mating engagement with threads on the male coupling body during mating of the couplings.

9. The electrical coupling as defined in claim 1, wherein each of the male and female coupling bodies have threads adjacent the connector receiving end of each coupling body for mated engagement with the first and second downhole tool housings, respectively.

10. The electrical coupling as defined in claim 9, further comprising:

a male coupling body seal carried on the male coupling body for sealing engagement between the first downhole tool housing and the male coupling body; and a female coupling seal carried on the female coupling body for mating engagement with the second downhole tool housing and the female coupling body.

11. An electrical coupling for interconnecting electrical conductors between a first electrical tool having a first exterior housing and a second electrical tool having a second exterior housing, the coupling having male and female bodies each having a conductor receiving end and a coupling mating end, the conductor receiving end of the male coupling body adapted for sealing engagement with the first electrical tool housing and the conductor receiving end of the female coupling body adapted for sealing engagement with the second electrical tool housing, the coupling further comprising:

primary coupling seal means for sealing engagement between the male and female coupling bodies when the coupling is mated;

pin connector means removably positioned within one of the coupling bodies and having at least one electrical connector pin extending axially therefrom;

socket connector means removably positioned within the other of the coupling bodies and having at least one electrical connector socket adapted to engage the at least one pin, the pin connector means and the socket connector means forming a mated connector means when the coupling is mated;

the male coupling body having a first stop surface radially outward from the connector means within the male coupling body for limiting axial movement of the mated connector toward the conductor receiving end of the male coupling body;

the female coupling body having a second stop surface radially outward from the connector means within the female coupling body for limiting axial movement of the mated connector toward the conductor receiving end of the female coupling body;

first stop means removably fixed to the connector means within the male coupling body for engagement with the first stop surface to limit axial movement of the mated connector means with respect to the male coupling body, such that the first stop means may be disconnected from the connector means within the unmated male coupling body, and the male coupling body then moved axially with respect to the connector means to remove the connector means from within the male coupling body through the conductor receiving end of the male coupling body;

second stop means fixed to the connector means within the female coupling body for engagement with the second stop surface for limiting axial movement of the mated connector means with respect to the female coupling body, such that the second stop means may be disconnected from the connector means within the unmated female coupling body, and the female coupling body then moved axially with respect to the connector means to remove the connector from within the female coupling body through the conductor receiving end of the female coupling body;

first backup seal means for sealing engagement between the male coupling body and the connector means within the male coupling body while the first stop means is in engagement with the first stop surface; and second backup seal means for sealing engagement between the female coupling body and the connector means within the female coupling body while the second stop means is in engagement with the second stop surface.

12. An electrical coupling as defined in claim 11, further comprising:

the pin connector means having a plurality of electrical connector pins extending axially therefrom;

the socket connector means having a plurality of electrical connector sockets therein adapted to engage the pins; and an alignment means on each of the male and female coupling bodies to rotatably align each of said plurality of pins with each of said plurality of sockets.

13. An electrical coupling as defined in claim 11, further comprising:

the male coupling body having a third stop surface for limiting axial movement of the connector means within the male coupling body toward the coupling mating end of the male coupling body; and the female coupling body having a fourth stop surface for limiting axial movement of the connector means within the female coupling body toward the coupling mating end of the female coupling body.

14. The electrical coupling as defined in claim 11, wherein each of the first and second stop means are threadably connected to the respective connector means.

15. The electrical coupling as defined in claim 11, wherein the male and female coupling bodies each include threads for repeatedly mating and unmating the coupling bodies.

16. The electrical coupling as defined in claim 11, further comprising:

each of the male and female coupling bodies have threads adjacent the connector receiving end of each coupling body for mated engagement with the first and second electrical tool housings, respectively;

a male coupling body seal carried in the male coupling body for sealing engagement between the first electrical tool housing and the male coupling body; and a female coupling body seal carried in the female coupling body for mating engagement with the second electrical tool housing and the female coupling body.

17. A method of assembling an electrical coupling for interconnecting first and second electrical conductors between a first electrical tool having a first exterior housing and a second electrical tool having a second exterior housing, the coupling having male and female bodies each having a conductor receiving end and a coupling mating end, the conductor receiving end of the male coupling body being fixed to and in sealing engagement with one of the electrical tool housings and the conductor receiving end of the female coupling body being fixed to and in sealing engagement with the second electrical tool housing, the method further comprising:

forming a first stop surface on the male coupling body for limiting axial movement of a mated connector within the male coupling body toward the conductor receiving end of the male coupling body;

forming a second stop surface on the female coupling body for limiting axial movement of a mated connector within the female coupling body toward the conductor receiving end of the female coupling body;

removably positioning a pin connector having the first electrical conductor connected thereto within one of the coupling bodies, the pin connector having at least one electrical connector pin extending axially therefrom;

removably positioning a socket connector having the second electrical conductor connected thereto within the other of the coupling bodies, the socket connector having at least one electrical connector socket adapted to engage the at least one pin:

sealing the male coupling body and the connector within the male coupling body;

sealing the female coupling body and the connector within the female coupling body;

inserting a first stop member through the mating end of the male coupling body and removably affixing the first stop member to the connector within the male coupling body and into engagement with the first stop surface;

inserting a second stop member through the mating end of the female coupling body and removably affixing the second stop member to the connector within the female coupling body and into engagement with the second stop surface; and mating the male and female coupling bodies into sealed engagement, such that the mated connector within the mated coupling is sealed from the environment.

18. The method as defined in claim 17, further comprising:

forming a third stop surface on the male coupling body for limiting axial movement of the connector within the male coupling body toward the coupling mating end of the male coupling body; and forming a fourth stop surface on the female coupling body for limiting axial movement of the connector within the female coupling body toward the coupling mating end of the female coupling body.

19. The method as defined in claim 17, wherein each of the first and second stop members are removably affixed to the respective connector by threads.

20. The method as defined in claim 17, wherein the male and female coupling bodies are each provided with threads for mating and unmating the coupling bodies.

* * * * *